US008870199B2

(12) United States Patent
Fehn

(10) Patent No.: US 8,870,199 B2
(45) Date of Patent: Oct. 28, 2014

(54) SPRING RESISTANT RISER SYSTEM

(76) Inventor: Lucien Theodore Fehn, Santa Cruz, CA (US)

( * ) Notice: Subject to any disclaimer, the term of this patent is extended or adjusted under 35 U.S.C. 154(b) by 301 days.

(21) Appl. No.: 13/311,961

(22) Filed: Dec. 6, 2011

(65) Prior Publication Data

US 2012/0146304 A1 Jun. 14, 2012

Related U.S. Application Data

(60) Provisional application No. 61/422,798, filed on Dec. 14, 2010.

(51) Int. Cl.

| | |
|---|---|
| ***B62M 1/00*** | (2010.01) |
| ***A63C 1/00*** | (2006.01) |
| ***A63C 17/01*** | (2006.01) |
| ***A63C 17/00*** | (2006.01) |

(52) U.S. Cl.

CPC ..... *A63C 17/0046* (2013.01); *A63C 17/012* (2013.01); *A63C 17/015* (2013.01)

USPC ..... 280/87.042; 280/11.27

(58) Field of Classification Search

CPC ..... B62K 3/002; A63C 17/01; A63C 17/012; A63C 17/06; A63C 17/02; B62B 3/007; B62B 11/00; A61H 3/04; A61H 2003/046

USPC ..... 280/87.041, 87.042, 87.01, 87.021, 280/11.27, 11.28

See application file for complete search history.

(56) References Cited

U.S. PATENT DOCUMENTS

| | | | | |
|---|---|---|---|---|
| 304,949 | A * | 9/1884 | Mitchell | 280/11.19 |
| 3,795,409 | A * | 3/1974 | Cudmore | 280/87.042 |
| 4,123,080 | A * | 10/1978 | Agajanian | 280/220 |
| 4,152,001 | A * | 5/1979 | Christianson | 280/11.28 |
| 4,155,565 | A * | 5/1979 | de Caussin et al. | 280/87.042 |
| 5,154,436 | A * | 10/1992 | Jez et al. | 280/87.042 |
| 5,868,408 | A * | 2/1999 | Miller | 280/87.042 |
| 7,070,193 | B2 * | 7/2006 | Yamaguchi | 280/87.042 |
| 7,896,364 | B1 * | 3/2011 | Ferreira | 280/11.27 |
| 8,083,241 | B2 * | 12/2011 | Corrente | 280/87.042 |
| 8,302,977 | B1 * | 11/2012 | Crutchfield | 280/87.042 |
| 2007/0052190 | A1 * | 3/2007 | Forsberg | 280/87.042 |
| 2008/0284121 | A1 * | 11/2008 | French | 280/87.042 |

* cited by examiner

*Primary Examiner* — J. Allen Shriver, II
*Assistant Examiner* — James M Dolak
(74) *Attorney, Agent, or Firm* — Donald R. Boys; Central Coast Patent Agency, Inc.

(57) ABSTRACT

A riser for mounting a skateboard truck to a skateboard undersurface has a base portion having a board mounting interface surface, an overall first height dimension, and two or more through-openings for fasteners to fasten the base portion firmly to the undersurface of the skateboard, and a cantilever portion extending away from the base portion for a first length, the cantilever portion having a thickness less than the first height dimension, leaving a clearance of a second dimension between the cantilever portion and the skateboard undersurface as mounted to the skateboard undersurface, and a pattern of holes through the cantilever portion for mounting a skateboard truck to the riser on a side of the riser away from the skateboard undersurface.

4 Claims, 7 Drawing Sheets

SPRING RESISTANT RISER SYSTEM

CROSS-REFERENCE TO RELATED DOCUMENTS

The present application claims priority to the provisional patent application 61/422,798 filed on Dec. 14, 2010, and all disclosure of the priority application is incorporated at least by reference.

BACKGROUND OF THE INVENTION

1. Field of the Invention

The present invention is in the field of recreational and sports equipment and accessories and pertains particularly to methods and apparatus for adding spring resistance between a skateboard and a truck assembly.

2. Discussion of the State of the Art

The art of skateboarding is practiced both as a recreational activity and as a serious sport. Typical skateboard tricks include various jumps, rail slides, and other acrobatic tricks involving a rider and the skateboard. When a skater rides a skateboard the natural momentum of the board, for example, at the beginning of a jump, is leveraged to keep the board in motion at the rider's feet. The truck assemblies of the board suffer some shock at especially heavy landings, and such landings can damage the board or the trucks, and may injure the rider because of a lack of or insufficient level of shock-absorbing properties in the truck assemblies of the board.

Therefore, what is clearly needed is a method and apparatus that provides resilient resistance between the truck assemblies and the board of the skateboard. Such a method and apparatus will enable softer landings and more leverage of board momentum in performing acrobatic tricks.

SUMMARY OF THE INVENTION

In one embodiment of the present invention a riser for mounting a skateboard truck to a skateboard undersurface is provided, comprising a base portion having a board mounting interface surface, an overall first height dimension, and two or more through-openings for fasteners to fasten the base portion firmly to the undersurface of the skateboard, and a cantilever portion extending away from the base portion for a first length, the cantilever portion having a thickness less than the first height dimension, leaving a clearance of a second dimension between the cantilever portion and the skateboard undersurface as mounted to the skateboard undersurface, and a pattern of holes through the cantilever portion for mounting a skateboard truck to the riser on a side of the riser away from the skateboard undersurface.

In one embodiment the riser is made of a polymer material and in another of a metal.

In an alternative embodiment the riser further comprises an extension of the base portion for a second length in the direction of the cantilever, extending the board mounting interface below the cantilever portion by the second length, the extension of the base portion having a width less than the width of the cantilever portion with a third through-opening for an additional fastener to fasten the base portion to the skateboard undersurface, and an opening in the cantilever portion of a width and length greater than the width and second length of the base extension, such that the extension of the base portion does not prevent the cantilever portion from flexing toward the skateboard undersurface.

In another aspect of the invention a method for mounting a skateboard truck to a skateboard undersurface to provide shock resiliency is provided, comprising the steps of (a) providing two risers each having a base portion having a board mounting interface surface, an overall first height dimension, and two or more through-openings for fasteners to fasten the base portion firmly to the undersurface of the skateboard, and a cantilever portion extending away from the base portion for a first length, the cantilever portion having a thickness less than the first height dimension, leaving a clearance of a second dimension between the cantilever portion and the skateboard undersurface as mounted to the skateboard undersurface; (b) mounting the risers in separate positions to the undersurface of a skateboard by fasteners through the through-openings; and (c) mounting a skateboard truck to each of the risers on the cantilever portion of each riser.

In one embodiment of the method the risers are made from a polymer material, and in another embodiment from metal. In an alternative embodiment of the method there is an extension of the base portion for a second length in the direction of the cantilever, extending the board mounting interface below the cantilever portion by the second length, the extension of the base portion having a width less than the width of the cantilever portion with a third through-opening for an additional fastener to fasten the base portion to the skateboard undersurface, and an opening in the cantilever portion of a width and length greater than the width and second length of the base extension, such that the extension of the base portion does not prevent the cantilever portion from flexing toward the skateboard undersurface.

In yet another aspect of the invention a skateboard is provided comprising an upper surface and an undersurface, two risers each having a base portion having a board mounting interface surface, an overall first height dimension, and two or more through-openings for fasteners to fasten the base portion firmly to the undersurface of the skateboard, and a cantilever portion extending away from the base portion for a first length, the cantilever portion having a thickness less than the first height dimension, leaving a clearance of a second dimension between the cantilever portion and the skateboard undersurface as mounted to the skateboard undersurface, and a skateboard truck mounted to each of the risers on the cantilever portion of each riser, such that weight applied to the upper surface causes the cantilever portions to flex, providing thereby relative movement between the skateboard trucks and the undersurface.

In one embodiment the skateboard further comprises an extension of the base portion of each riser for a second length in the direction of the cantilever, extending the board mounting interface below the cantilever portion by the second length, the extension of the base portion having a width less than the width of the cantilever portion with a third through-opening for an additional fastener to fasten the base portion to the skateboard undersurface, and an opening in the cantilever portion of each riser of a width and length greater than the width and second length of the base extension, such that the extension of the base portion does not prevent the cantilever portion from flexing toward the skateboard undersurface.

BRIEF DESCRIPTION OF THE DRAWING FIGURES

Figure 9A:
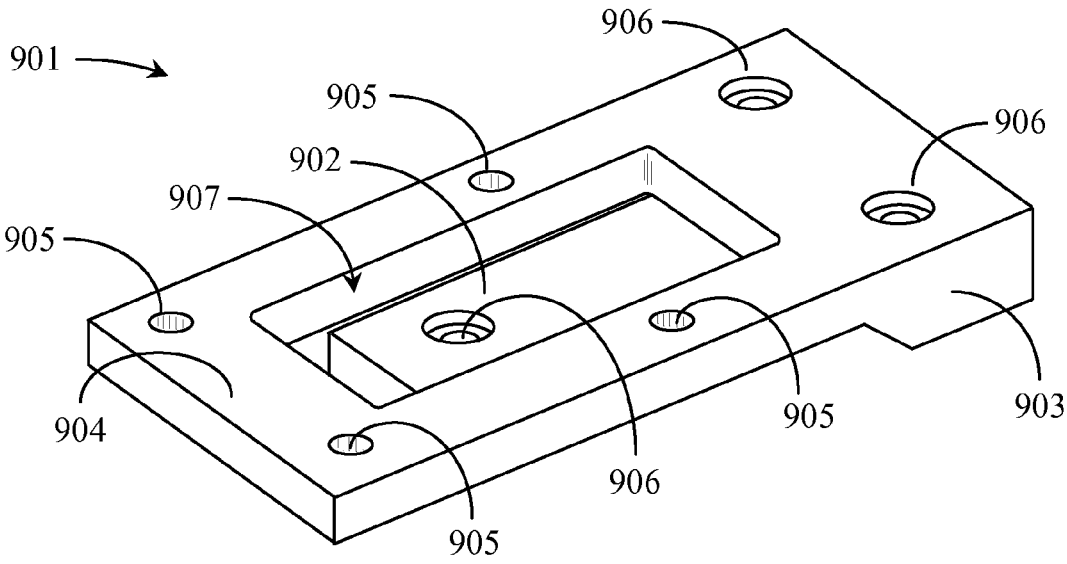

FIG. 9*a* is a perspective view of a riser having a stabilizer portion in addition to the base portion and a cantilevered portion.

Figure 9B:
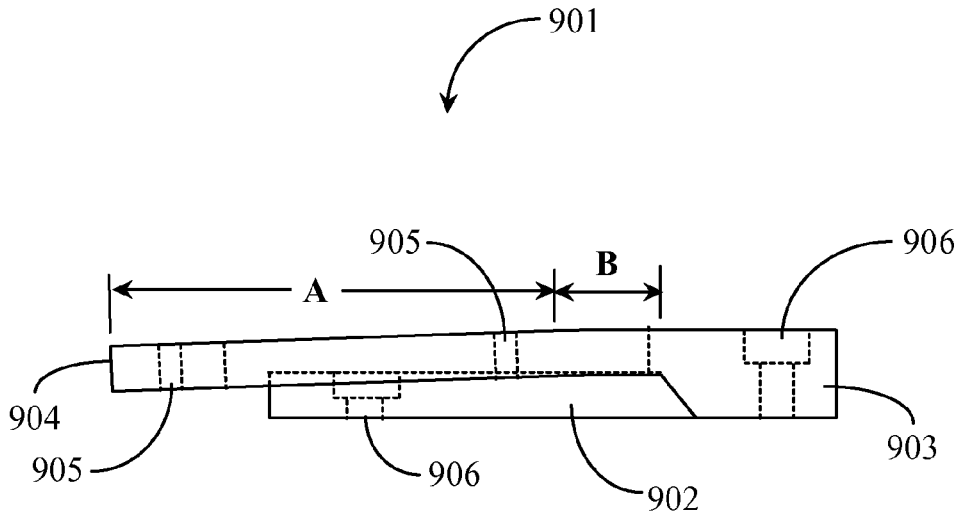

FIG. 9*b* illustrates the riser of FIG. 9*a* in side elevation with the cantilever portion flexed.

Figure 10:
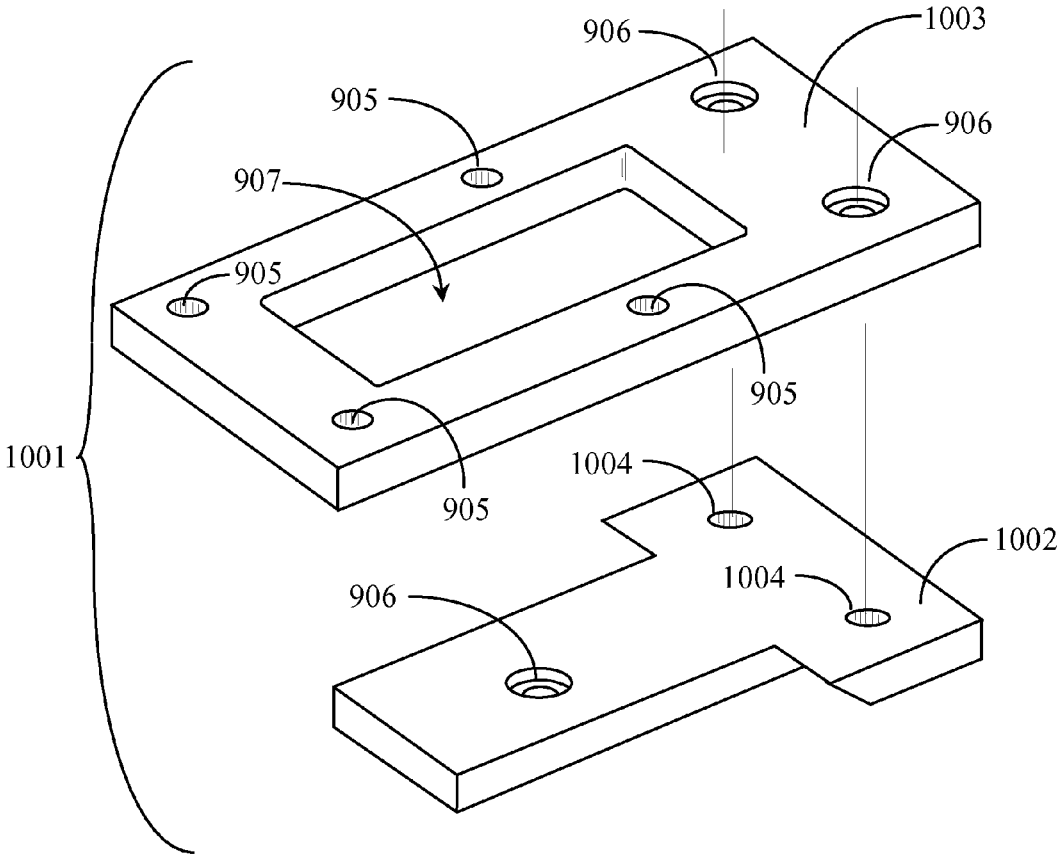

FIG. 10 illustrates an alternative embodiment for providing a riser with a stabilizer portion.

DETAILED DESCRIPTION

The inventor provides a skateboard with resilient riser parts having spring-like action installed between the board and truck assemblies of the board. The present invention is described in enabling detail below using examples which may describe more than one relevant embodiment falling within the scope of the present invention.

Figure 1:
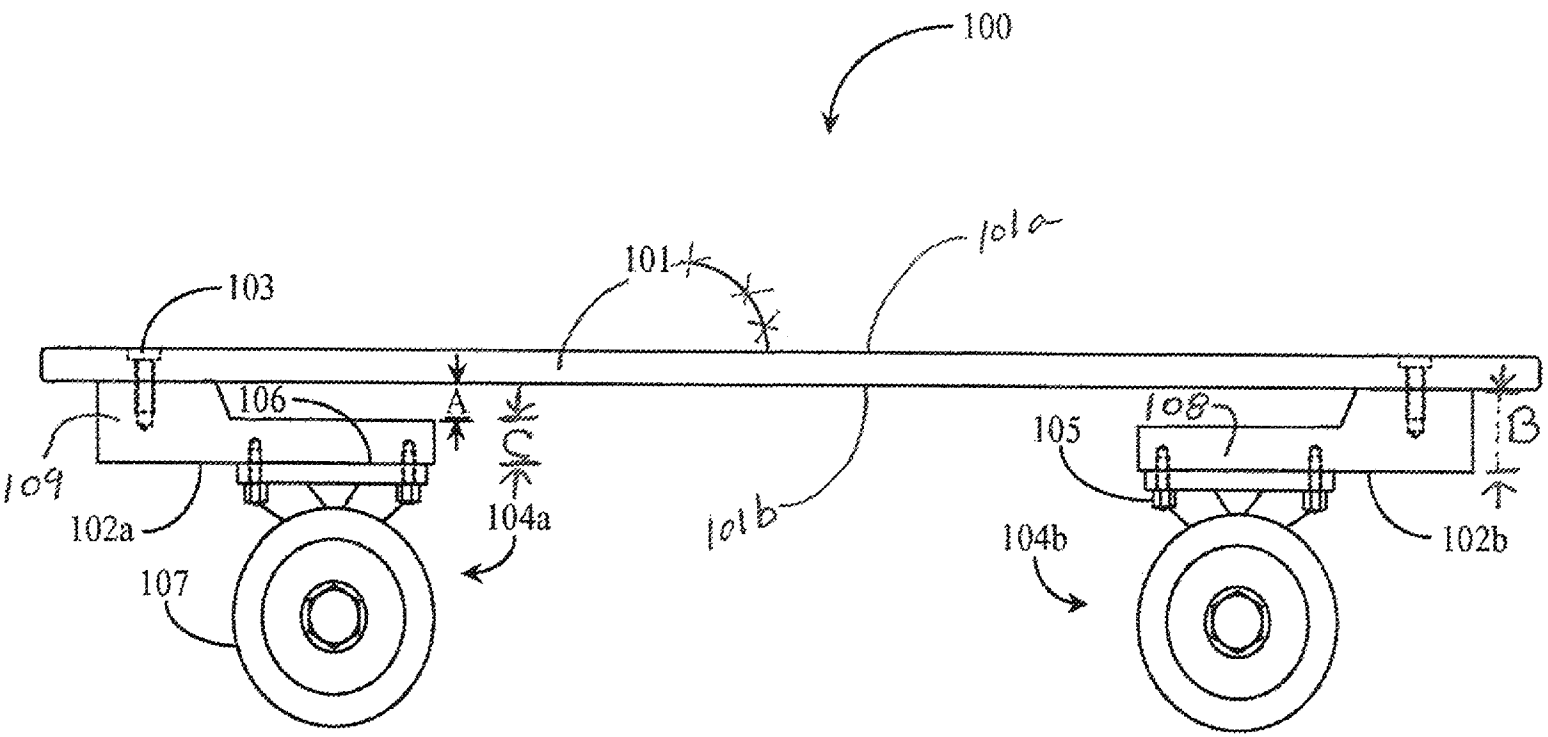
FIG. 1 is an elevation view of a skateboard with riser parts according to an embodiment of the present invention.

Referring now to FIG. 1, a skateboard 100 is illustrated in elevation view. Skateboard 100 includes a board 101 manufactured of typical materials used in skateboard manufacture having an upper surface 101*a* and an undersurface 101*b*. Intermediate riser parts 102*a* and 102*b* (one per end) are provided in between board 101 and standard truck assemblies 104*a* and 104*b*.

Riser parts 102*a* and 102*b* may be manufactured of a resilient polymer or other material having spring-resistant properties. In a preferred embodiment each riser part 102*a*, and 102*b* is formed having a base portion 109 that is mounted directly to board 101 using bolts 103, and a cantilevered portion 108 that extends longitudinally toward the center portion of board 101. It is not required that the cantilevered portion extend toward the center, as the mounting to the board might be adjusted accordingly so that the extension could be away from center, but the present arrangement is sufficient to explain the invention.

The cantilevered portion of riser part 102*a* and 102*b*, has a height dimension C less than a height dimension B of the base portion leaving a gap providing dimension A between the underside of board 101 and upper surface of the cantilever portion 108 of each riser part. The length and/or the dimension C of the cantilevered portion 108 of the riser part can be controlled in manufacturing to increase or decrease the spring resistance of the cantilever arm.

Standard truck assemblies 104*a* and 104*b* are mounted directly to the cantilevered arms of riser parts 102*a* and 102*b* via bolts 105 through openings provided in assembly truck bases 106. A user riding skateboard 100 benefits by added shock absorption properties provided by the spring resilience of the cantilevered riser parts 102*a* and 102*b*. Likewise, natural board momentum, such as at the beginning of a vertical jump, is significantly increased by virtue of riser parts 102*a* and 102*b* flexibility and spring resistance properties, much in the manner that a diver might manipulate a springboard when diving.

Figure 2:
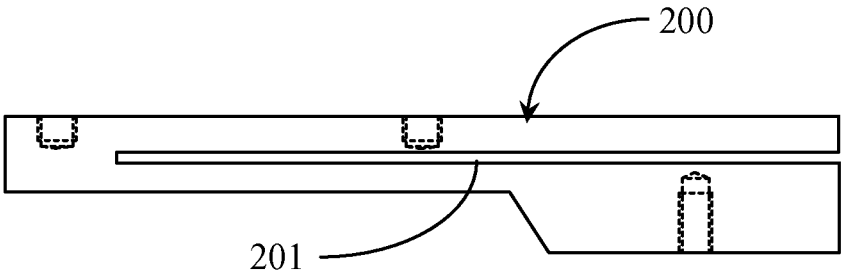
FIG. 2 is a side view of a riser part with a slot for spring steel re-enforcement.

Referring now to FIG. 2, a riser part 200 is illustrated in side view. Riser part 200 is similar in material and construction to riser parts 102*a* and 102*b* of FIG. 1. An exception is that riser part 202 has a slot 201 machined horizontally through the base portion of riser 202 and extending substantially into the cantilevered portion of the riser part. Slot 201 has a width suitable for insertion of a piece of spring steel used to re-enforce the spring resistant properties of the cantilever portion of the riser part. In this embodiment the riser may be manufactured of a polymer material, for example, such as by molding, and the spring rate of the cantilever portion may be controlled by the thickness and the nature of the material, such as tempered steel, that may be inserted into slot 201.

Figure 3:
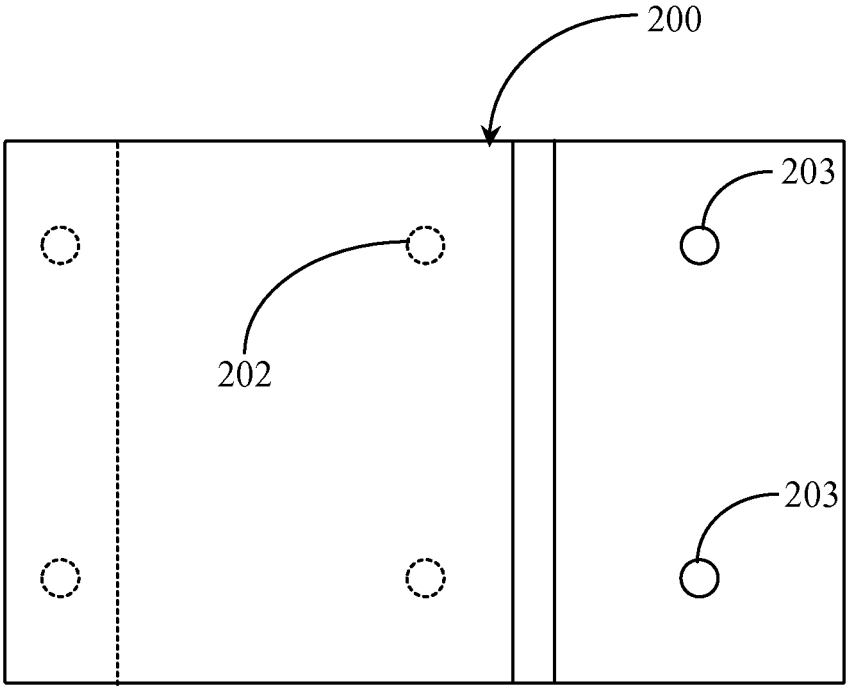
FIG. 3 is a bottom view of the riser part of FIG. 3.

Referring now to FIG. 3, riser part 200 is illustrated in bottom view. Riser part 200 in this embodiment is mounted to the underside of a skateboard using two threaded holes 203 as described further above with respect to riser parts 102*a* and 102*b*. A standard truck assembly such as assembly 104*a* of FIG. 1 mounts directly to the cantilevered arm of riser part 200 using threaded openings 202. It is noted herein that in all embodiments threaded inserts such as helicoils might be provided in place of finished tapped holes.

Figure 4:
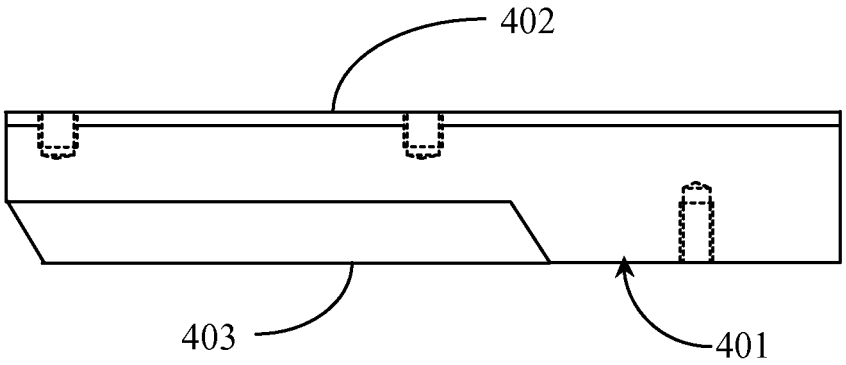
FIG. 4 is a side view of a riser part re-enforced with rubber and spring steel.

Referring now to FIG. 4, a riser part 401 is illustrated in side view in this example. Like all of the riser parts previously described, riser part 401 has a base portion and an extended cantilevered portion. In this embodiment a piece of spring steel 402 is mounted to the surface of riser part 401 that interfaces with a standard truck assembly. This version is an alternative to the slotted version described in FIG. 2.

Figure 5:
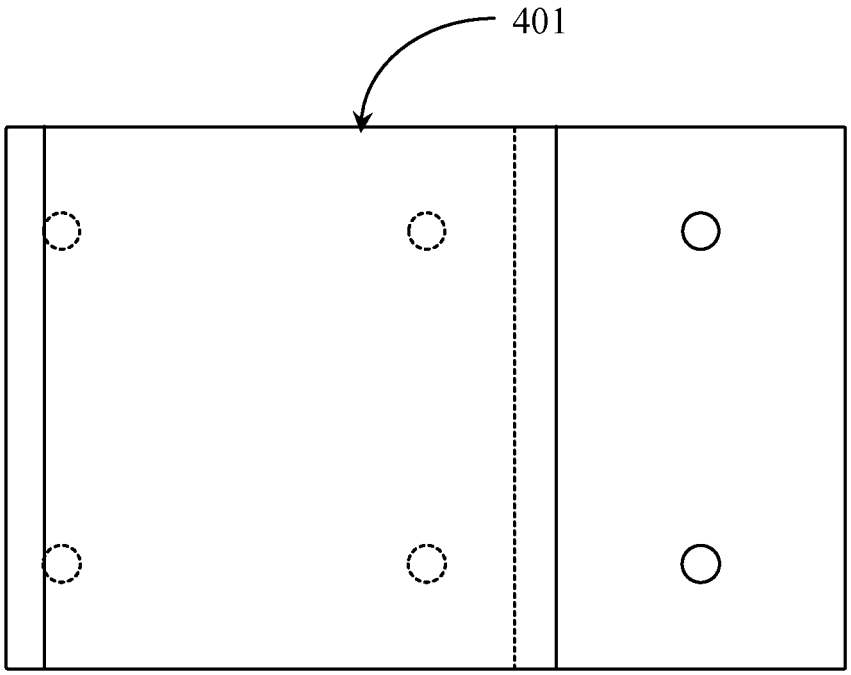
FIG. 5 is a bottom view of the riser part of FIG. 4.

In one embodiment of the present invention, a piece of stiff rubber 403 or similar resilient material may be provided to fill the gap between the board and the cantilevered portion of riser part 401. The rubber insert may be glued or mounted directly to the underside of the board. Rubber 403 may be used to re-enforce spring resistance in addition to or in place of the spring steel. Openings may be provided through the spring steel plate 402 to facilitate truck assembly mounting of a standard truck assembly. Referring now to FIG. 5, riser part 401 is illustrated in bottom view showing truck mount openings (backside) and board-mount openings.

Figure 6:
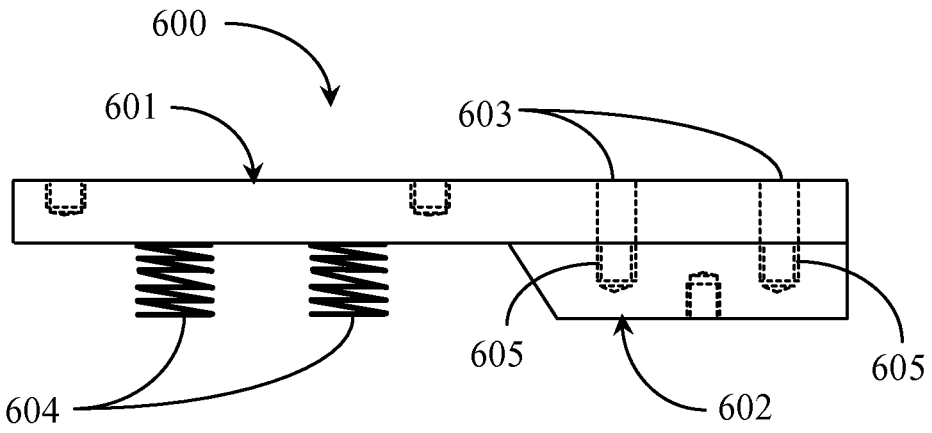
FIG. 6 is a side view of a riser part assembly re-enforced with springs.

Referring now to FIG. 6, a riser part assembly 600 is illustrated in side view. Riser part 600 is an assembly in this embodiment including a base part 602 mounted to a cantilever arm 601. Openings 603 are provided through cantilever part 601 matching threaded holes 605 in base portion 602 so cantilever 601 may be bolted to base portion 602. In one embodiment part 602 may be provided in other ways to mate with cantilever portion 601 without using bolts or screws to assemble the riser.

In this example, riser assembly 600 may further include steel springs 604 placed in the gap between the riser assembly cantilevered arm and the underside of the skateboard to increase the spring rate if desired.

Figure 7:
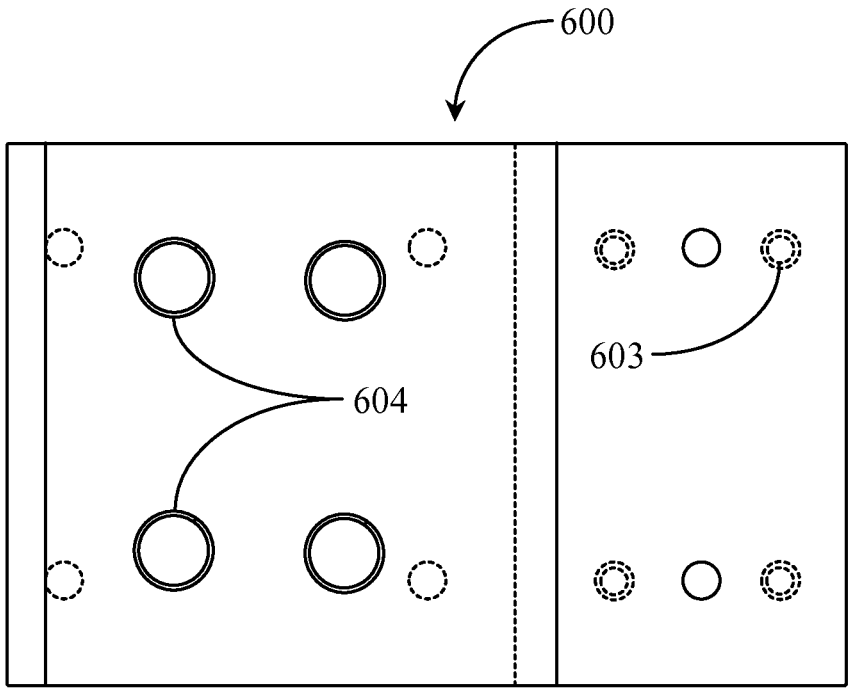
FIG. 7 is a bottom view of the riser part assembly of FIG. 6.

Referring now to FIG. 7, assembly 600 is illustrated in bottom view showing four springs 604 and four openings 603 provided to assemble the two pieces, base 602 and cantilevered arm 601 together.

Figure 8:
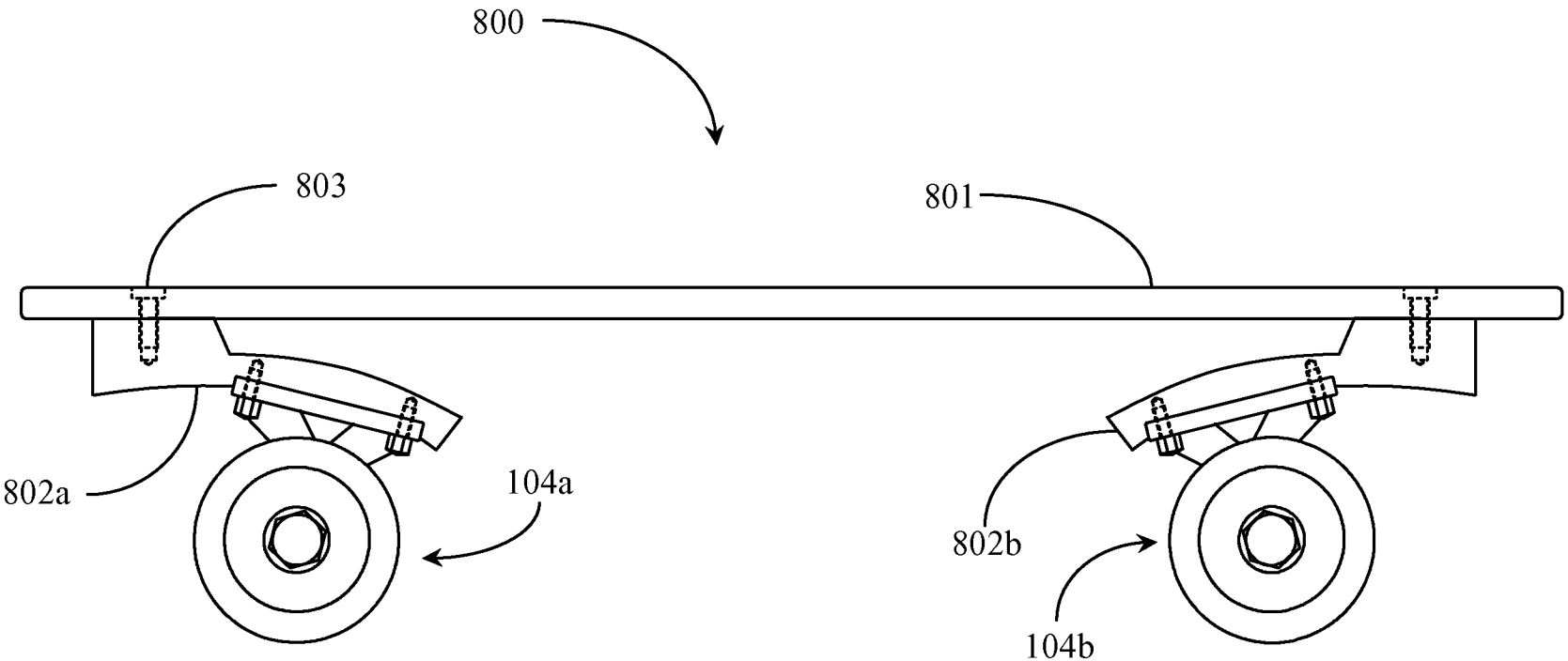
FIG. 8 is an elevation view of a skateboard with bowed riser parts according to an embodiment of the present invention.

Referring now to FIG. 8, a skateboard 800 is illustrated in elevation view. Skateboard 800 has specially formed riser parts 802*a* and 802*b*. In this example, riser parts 802*a* and 802*b* are shaped or formed to arc away from the underside of the board 801 when mounted at their base portions using bolts 803. The arcing of the cantilevered portions of risers 802*a* and 802*b* provides reinforcement to the spring resistant properties of the cantilevers. The standard truck assemblies 104*a* and 104*b* are mounted to the cantilever arms as described further above although some machining for clearance and for surface to surface mating might be performed before mounting the truck assemblies to the cantilevered arms. This embodiment may be practiced with or without a spring steel insert or side plate. In this embodiment the shape or physical form of the riser part is altered to increase to property of spring resistance.

FIG. 9*a* is a perspective view of a riser 901 having a stabilizer portion 902 in addition to the base portion 903 and the cantilevered portion 904. In some severe use cases, wherein experienced and talented riders do complicated maneuvers with a skateboard with risers according to embodiments of this invention, it has been discovered by the inventors that heavy torsional loads, that is, loads that tend to cause the riser to rotate in the plane of the board, tend to cause the two fasteners that secure the riser to the board (see FIG. 1 bolts 103) to loosen somewhat, allowing some unwanted movement of the riser relative to the board.

In the riser embodiment illustrated in FIG. 9*a* a rectangular opening 907 is provided through the cantilever portion 904 of the riser, and an extension 902 of the base portion is provided extending above the cantilever portion (the riser is shown here inverted from its use orientation). Extension 902 is of a width to fit within the width of opening 907, so when the cantilever portion bends, the extension 902 of the base portion does not interfere with its movement. Further a third counter-bored hole 906 is provided through extension 902 of the base portion, providing now three fastening points for the riser to the board, the three points in a triangular pattern. Fastening the riser to the board at the three points provides a much more secure resistance to rotational movement of the riser relative to the board in severe operation. Holes 905 in a rectangular pattern are for mounting the truck to the riser, as in embodiments described above.

FIG. 9*b* is a side elevation view of riser 901 of FIG. 9*a* with the cantilever portion shown flexed several degrees, as might be the case in use under substantial vertical loading by a rider. It should be noted that the region of cantilever portion 904 over dimension A will stay substantially straight, rather than curved as flexure occurs, because the truck will be bolted to the cantilever portion though holes 905. Flexure will occur over the region denoted by dimension B. It should be noted as well that in this version the base portion 903, the cantilever portion 904 and the base extension 902 are all of a single piece. This may be accomplished, for example, in any one of several ways. In one case the riser is manufactured from a single rectangular block beginning with the overall length, height and width of the riser, by machining away portions to provide the final shape shown, and then tempering, heat treating or flame treating the machined riser to provide suitable flexure properties. In some cases, depending on material and dimensions, no such after-treatment will be needed. In another case the riser may be cast or molded, and suitable after-treatments may be accomplished to temper the shaped riser.

FIG. 10*a* is an exploded perspective view of a riser assembly 1001 having a base portion 1002 and a cantilever portion 1003 which are each machined from separate flat blanks Portion 1003 has the same holes 905 and 906 as shown in FIG. 9*a*, and base portion 1002 has a counter-bored hole 906 and through-holes 1004 that align with counter-bored holes 906 in portion 1003. This version has an advantage in machining cost, and when assembled has the same shape and function as riser 901 shown in FIG. 9*a*.

It will be apparent to one with skill in the art that the skateboard riser system of the invention may be provided using some combination or all of the features described above and components without departing from the spirit and scope of the present invention. It will also be apparent to the skilled artisan that the embodiments described above are specific examples of a single broader invention, which may have greater scope than any of the singular descriptions taught. There may be many alterations made in the descriptions without departing from the spirit and scope of the present invention. The scope of the invention is limited only by the claims which follow.

The invention claimed is:

1. A riser for mounting a skateboard truck to an undersurface of a skateboard, comprising:

a base portion having a board mounting interface surface, an overall first height dimension, and two or more through-openings for fasteners to fasten the base portion directly to the undersurface of the skateboard; and a cantilever portion integrally formed with the base portion extending away from the base portion for a first length, the cantilever portion having a thickness less than the first height dimension, leaving a gap of a second dimension between the cantilever portion and the skateboard undersurface as mounted to the skateboard undersurface;

a pattern of holes through the cantilever portion for mounting the skateboard truck to the riser on a side of the riser away from the skateboard undersurface; and a slot machined horizontally within and through the base portion extending more than half way into the cantilevered portion allowing insertion of one of a plurality of differing materials controlling reinforcement of spring resistant properties of the cantilevered portion.

2. The riser of claim 1 made from a polymer material.

3. The riser of claim 1 made from a metal.

4. A skateboard comprising:

an upper surface and an undersurface;

two risers each having a base portion having an overall first height dimension, and two or more through-openings for fasteners to fasten the base portion directly to the undersurface of the skateboard, and a cantilever portion extending away from the base portion for a first length, the cantilever portion having a thickness less than the first height dimension, leaving a gap of a second dimension between the cantilever portion and the skateboard undersurface as mounted to the skateboard undersurface;

a slot machined horizontally within and through the base portion extending more than half way into the cantilevered portion allowing insertion of a selected one of a plurality of differing materials;

a skateboard truck mounted to each of the risers on the cantilever portion not encompassing the slot of each riser;

such that weight applied to the upper surface causes the cantilever portions to flex according to reinforcement of spring resistant properties of the cantilevered portion controlled by the insertion of the selected material, providing thereby relative movement between the skateboard trucks and the undersurface.

* * * * *